US010699689B2

(12) United States Patent
Biermeier

(10) Patent No.: US 10,699,689 B2
(45) Date of Patent: Jun. 30, 2020

(54) REGULATING OR CONTROL DEVICE AND METHOD FOR IMPROVING A NOISE QUALITY OF AN AIR-CONDITIONING SYSTEM

(71) Applicant: AUDI AG, Ingolstadt (DE)

(72) Inventor: Thomas Biermeier, Gaimersheim (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 16/211,653

(22) Filed: Dec. 6, 2018

(65) Prior Publication Data

US 2019/0189103 A1 Jun. 20, 2019

(30) Foreign Application Priority Data

Dec. 14, 2017 (DE) ..... 10 2017 222 750

(51) Int. Cl.

| | |
|---|---|
| ***G10K 11/16*** | (2006.01) |
| ***F24F 13/24*** | (2006.01) |
| ***G10K 11/175*** | (2006.01) |
| ***G10K 11/162*** | (2006.01) |
| ***H04R 3/04*** | (2006.01) |
| ***H04R 3/00*** | (2006.01) |

(52) U.S. Cl.

CPC ..... *G10K 11/175* (2013.01); *F24F 13/24* (2013.01); *G10K 11/161* (2013.01); *G10K 11/162* (2013.01); *H04R 3/00* (2013.01); *H04R 3/04* (2013.01); *H04R 2499/13* (2013.01)

(58) Field of Classification Search

CPC ..... H04R 3/00; H04R 3/04; H04R 2499/13; G10K 11/16; G10K 11/161; G10K 11/162; G10K 11/175; G10K 2210/112; F24F 13/24; F24F 13/242; F24F 13/245

See application file for complete search history.

(56) References Cited

U.S. PATENT DOCUMENTS 5,119,427 A * 6/1992 Hersh ..... G10K 11/172 381/71.14
5,404,409 A * 4/1995 Nagami ..... F01N 1/065 381/71.12
2007/0281600 A1* 12/2007 Thawani ..... B60H 1/00564 454/148

(Continued)

FOREIGN PATENT DOCUMENTS

DE 10 2007 001 007 B4 12/2008
DE 60 2006 000 853 T2 5/2009

(Continued)

OTHER PUBLICATIONS

Examination Report dated Jul. 27, 2018 of corresponding German application No. 10 2017 222 750.8; 7 pages including Machine-Generated English-language Translation Attached.

*Primary Examiner* — Thang V Tran
(74) *Attorney, Agent, or Firm* — Maier & Maier, PLLC

(57) ABSTRACT

A method for influencing an acoustic noise of an air-conditioning system of a vehicle, wherein a psychoacoustic variable, in particular a sharpness of the sound, of the air-conditioning system is reduced by influencing a low-frequency and/or medium-frequency spectral component of a frequency spectrum of the sound of the air-conditioning system. A regulating or control device for carrying out the method.

6 Claims, 1 Drawing Sheet

(56) References Cited

U.S. PATENT DOCUMENTS

| | | | | |
|---|---|---|---|---|
| 2008/0032618 | A1* | 2/2008 | Katoh | B60H 1/00564 454/143 |
| 2010/0082201 | A1 | 4/2010 | Pfau et al. | |
| 2010/0163209 | A1* | 7/2010 | Eguchi | B60H 1/00028 165/41 |
| 2015/0260816 | A1* | 9/2015 | Liang | G01R 33/5608 324/309 |
| 2018/0238583 | A1* | 8/2018 | Jeong | F24F 13/24 |

FOREIGN PATENT DOCUMENTS

| | | | | |
|---|---|---|---|---|
| DE | 10 2012 212 843 | A1 | | 1/2014 |
| DE | 10 2012 108 911 | A1 | | 3/2014 |
| DE | 10 2013 214 201 | A1 | | 1/2015 |
| DE | 102013214201 | A1 | * | 1/2015 |
| JP | 2009036603 | A | * | 2/2009 |

* cited by examiner

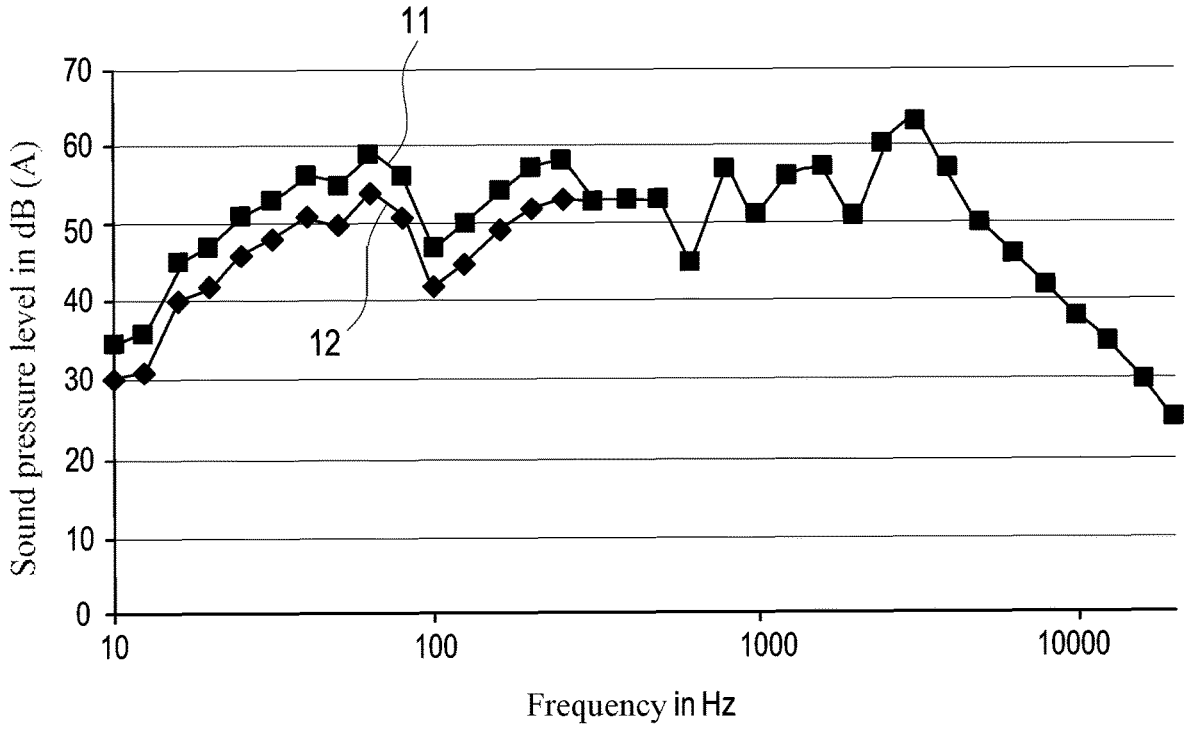
11
12
70
60
50
40
30
20
10
0
Sound pressure level in dB (A)
10
100
1000
10000
Frequency in Hz

REGULATING OR CONTROL DEVICE AND METHOD FOR IMPROVING A NOISE QUALITY OF AN AIR-CONDITIONING SYSTEM

FIELD

The invention relates to a method and a regulating or control device for improving a noise quality of an air-conditioning system.

BACKGROUND

In order to make possible an optimal feeling of comfort for a vehicle passenger, present-day vehicles are often equipped with an air-conditioning system. The function of the air-conditioning system is to provide, regardless of the weather or any waste heat, a passenger compartment atmosphere that is desired by the vehicle passenger. When an air-conditioning system of this kind is operated, however, devices within the air-conditioning system, in particular a fan of the air-conditioning system, which conveys air in the air-conditioning system, give rise to acoustic noise. This acoustic noise can be heard especially intensely when a vehicle motor is at a standstill. Because, in addition, vehicle drives are becoming increasingly quieter, the acoustic noise is becoming ever more strongly perceivable by a vehicle passenger, because noises due to the vehicle drive or other noises are not superimposed on this acoustic noise. Accordingly, the acoustic noise of the air-conditioning system is increasingly becoming an interfering noise for multimedia devices, for example, that are utilized in the vehicle.

Known from the document DE 10 2012 212 843 A1 is an air-conditioning unit, wherein the air-conditioning unit comprises a device for noise reduction, which has an analysis unit and a control unit and which produces sound waves that, through destructive interference, are designed to dampen the sound waves emitted by a fan of the air-conditioning unit.

Known in the prior art are regulating or control devices for air-conditioning systems that are designed to reduce an acoustic noise or an interfering noise of the air-conditioning system. In this case, a reduction in the acoustic noise or in the interfering noise occurs primarily via a reduction in a sound pressure level of the acoustic noise/interfering noise of the air-conditioning system. A sound pressure level is a logarithmic variable describing a magnitude of a sound event. The sound pressure level has been reduced up to now, for example, by using porous absorbers to reduce or to absorb high-frequency spectral components of a frequency spectrum of the noise. However, porous absorbers have the drawback that both the manufacturing materials and the underlying manufacturing technologies are very cost-intensive. The porous absorbers are also subject to physical limits in terms of their efficiency. Furthermore, it is known how to achieve the sound pressure level through a reduction in a low-frequency and medium-frequency spectral component of the frequency spectrum of the sound via active systems ("active noise cancelling") or by destructive superimposition. However, it is disadvantageous here that, with a great application effort, high hardware costs and package problems must be anticipated.

SUMMARY

The object of the invention is thus to provide a method and a regulating or control device for an air-conditioning system, through which an improvement in a noise quality of the air-conditioning system is made possible.

This object is achieved by a method and by a regulating or control device.

The subject of the invention is a method for influencing an acoustic noise of an air-conditioning system of a vehicle.

In this case, the method comprises a reduction in a psychoacoustic variable, in particular a sharpness of the sound, of the air-conditioning system by influencing a low-frequency and/or medium-frequency spectral component of a frequency spectrum of the sound of the air-conditioning system. Preferably, the influencing is carried out by a regulating or control device, wherein the regulating or control device is designed to influence the noise acoustics of the air-conditioning system, in particular by influencing the sound of the air-conditioning system. In this way, it is possible to improve decisively a subjectively perceived noise quality of the air-conditioning noises of the air-conditioning system.

In particular, the sound of the air-conditioning system is influenced by influencing a psychoacoustic variable—in particular a sharpness—of the sound of the air-conditioning system. The sharpness is a key component of the tone and a perceived variable of the psychoacoustics. It can be derived from the results of experiments in which test subjects arrange noises reproducibly along a scale from dull to sharp, regardless of pitch, loudness, and harshness. The sharpness of the sound can be influenced by a change in spectral components of a frequency spectrum of the sound. Thus, a large imbalance between a low-frequency, a medium-frequency, and a high-frequency spectral component of the frequency spectrum of the noise, in particular, a high proportion of high-frequency spectral components in comparison to low-frequency and/or medium-frequency spectral components of the frequency spectrum, is perceived as being especially "sharp."

Influencing the sound via influencing the psychoacoustic variable "sharpness" of the sound makes it possible to improve the noise quality, because a lowering of a sound pressure level solely via porous absorbers is subject to physical limits. In a further step, the method comprises influencing the sharpness of the sound of the air-conditioning system by influencing a low-frequency and/or a medium-frequency spectral component of a frequency spectrum of the sound of the air-conditioning system. This offers the advantage that influencing the low-frequency and/or medium-frequency spectral components of the frequency spectrum of the sound makes possible a reduction in the sharpness of the acoustic noise, as a result of which an overall improvement in the noise quality of the air-conditioning system of the vehicle can be achieved. Furthermore, influencing the low-frequency and/or medium-frequency spectral component of the frequency spectrum requires no further active systems by means of which noise components are diminished by a destructive superimposition in order to achieve an improvement in the noise quality.

In an embodiment, the sharpness of the acoustic noise is influenced by enhancing the low-frequency and/or medium-frequency spectral component of the frequency spectrum of the sound of the air-conditioning system. The enhancement of the low- frequency and/or medium-frequency spectral component is achieved by introducing an additional frequency component via an actuator. What is usually involved in the case of such an actuator is a speaker. In addition, a microphone can be used in a control loop. As a rule, a microphone that is already present in the vehicle, such as, for example, a microphone for telecommunication, is used for this purpose. Through enhancement of the low-frequency and/or medium-frequency spectral component of the frequency spectrum of the sound, a sharpness of the sound is reduced. The amount by which the spectral component needs to be enhanced is determined, as a rule, in each individual case. Thus, in the case of a high proportion of the high-frequency spectral component, an enhancement of the low-frequency and/or medium-frequency spectral component results in a equalization of a weighting of the spectral components (low-frequency, medium-frequency, high-frequency), as a result of which the sharpness perception of the sound is reduced. Typically, in the case of a strong imbalance in the spectral components, the perceived sharpness is greatest. As a rule, an addition of particularly low-frequency spectral components brings about an especially strong reduction in the sharpness. Whether a low-frequency and/or a medium-frequency spectral component is or are enhanced needs to be determined in each individual case. A low-frequency spectral component lies preferably in a range of <300 Hz. A medium-frequency spectral component lies preferably between 300 Hz and 800 Hz. A high-frequency spectral component lies preferably in a range of >800 Hz.

Use of the method according to the invention thus makes it possible, in addition, to reduce any required diminution in the high-frequency spectral components of the frequency spectrum of the sound, because, through the enhancement of the low-frequency and/or medium-frequency spectral components, a smaller reduction in the high-frequency spectral component is needed in order to achieve an equalization of the individual spectral components (low-frequency, medium-frequency and high-frequency). In addition, a method having the described features also reduces both the manufacturing costs and the total weight of the air-conditioning system, because a regulating or control device that is required for carrying out the method is preferably a regulating or control device that is already present in the air-conditioning system. In addition, through the method according to the invention, additional degrees of freedom for generation of a target sound are made possible, because, owing to the possibility of enhancing the low-frequency and/or medium-frequency spectrum component, a greater number of possible variations for weighting the spectral components are achievable.

In an enhancement of the method, in addition to the enhancement of the low-frequency and/or medium-frequency spectral component of the frequency spectrum of the sound, a high-frequency spectral component of the frequency spectrum of the sound is influenced by a porous absorber. By the additionally influence of the high-frequency spectral component of the sound by the porous absorber, under certain circumstances, only a small influencing of the low-frequency and/or medium-frequency spectral component of the frequency spectrum of the sound is necessary in order to reduce the perceived sharpness and to improve the noise quality.

Advantageously, influencing of the sharpness of the sound is carried out by reducing the high-frequency spectral component of the frequency spectrum of the sound of the air-conditioning system by way of the porous absorber. By the reduction in the high-frequency spectral component of the frequency spectrum of the sound of the air-conditioning system by the porous absorber, a lesser enhancement of the low-frequency and/or medium-frequency spectral component of the frequency spectrum of the noise is necessary in order to reduce the perceived sharpness and thus to improve the noise quality. Especially advantageously, in this case, there occurs a reduction in the high-frequency spectral component of the frequency spectrum at the same time as an enhancement in the low-frequency and/or medium-frequency spectral component of the frequency spectrum. This offers the advantage that an equalization of the spectral components (low-frequency, medium-frequency, high-frequency) can be achieved as fast as possible, as a result of which a perceived sharpness of the sound can be reduced especially rapidly. The utilization of porous absorbers represents a reliable possibility for diminishing the high-frequency spectral components of the frequency spectrum.

The subject of the invention is, in addition, a regulating or control device for carrying out a method in accordance with one of the features described above.

In accordance with the invention, the regulating or control device is designed to influence a psychoacoustic variable of the sound, in particular a sharpness of the sound, of an air-conditioning system by influencing at least one spectral component of a frequency spectrum of the sound of the air-conditioning system. The sharpness is a key component of the tone and a perceived variable of the psychoacoustics. It can be derived from the results of experiments in which test subjects arrange sounds reproducibly along a scale from dull to sharp, regardless of pitch, loudness, and harshness. The sharpness of the sound can be influenced by a change in spectral components of a frequency spectrum of the sound. Thus, a large imbalance between low-frequency, medium-frequency, and high-frequency spectral components of the frequency spectrum of the sound, in particular, a high proportion of high-frequency spectral components in comparison to low-frequency and/or medium-frequency spectral components of the frequency spectrum, is perceived as being especially "sharp."

In this case, the regulating or control device is preferably an actuator, which is preferably already present in the air-conditioning system as, for example, an "onboard sound system" and/or a processing unit, such as, for example, a body control module (BCM). Alternatively, the actuator can be designed as a separate speaker. In addition, it is possible to let run an algorithm for controlling the air-conditioning system on a control unit (digital signal processor, DSP) or on a processing unit separately developed for this purpose.

In an embodiment, the regulating or control device is designed to influence a low-frequency and/or medium-frequency spectral component of the sound of the air-conditioning system. This offers the advantage that, through influencing the low-frequency and/or medium-frequency spectral components of the frequency spectrum of the sound, the regulating or control device is designed to make possible a reduction in the sharpness of the acoustic noise, as a result of which an overall improvement in the noise quality of the air-conditioning system of the vehicle is achievable.

In an enhancement of the invention, the regulating or control device is designed to enhance a low-frequency and/or medium-frequency spectral component of the sound of the air-conditioning system. This offers the advantage that the sharpness of the sound of the air-conditioning system can be reduced, because, in the case of a high proportion of a high-frequency spectral component of the sound, an enhancement of the low-frequency and/or medium-frequency spectral component of the sound can result in an equalization of a weighting of the spectral components (low-frequency, medium-frequency , high-frequency). Through the equalization of the weighting of the spectral components of the sound, it is possible to reduce a perceived sharpness of the sound. In addition, a regulating or control device of this kind reduces both the manufacturing costs and the total weight of the air-conditioning system, because, as the basis for the regulating or control device according to the invention, preferably a regulating or control device that is already present in the air-conditioning system is utilized. In addition, the regulating or control device according to the invention makes possible additional degrees of freedom for the generation of a target sound, because, due to the possibility of enhancing the low-frequency and/or medium-frequency spectrum component, the regulating or control device is designed to achieve a larger number of possible variations for weighting the spectral components.

Advantageously, the regulating or control device is designed to interact with a porous absorber, which is designed to influence a high-frequency spectral component of the sound of the air-conditioning system. By influencing the high-frequency spectral component by a porous absorber, under certain circumstances, only a slight influencing of the low-frequency and/or medium-frequency spectral component of the frequency spectrum of the sound by the regulating or control device is necessary in order to reduce the perceived sharpness and to improve the noise quality.

Especially preferred, the regulating or control device is designed to interact with a porous absorber, which is designed to reduce a high-frequency spectral component of the sound of the air-conditioning system. Advantageously, influencing the sharpness by a reduction in the high-frequency spectral component of the frequency spectrum of the sound of the air-conditioning system by a porous absorber additionally results. By the reduction in the high-frequency spectral component of the frequency spectrum of the sound of the air-conditioning system by a porous absorber, a smaller enhancement of the low-frequency and/or medium-frequency spectral component of the frequency spectrum of the sound by the regulating or control device is necessary, in order to reduce the perceived sharpness and thus improve the noise quality. Especially advantageously, in the case of a reduction in the high-frequency spectral component of the frequency spectrum by the porous absorber, the regulating or control device is designed to make it possible to carry out at the same time an enhancement of the low-frequency and/or medium-frequency spectral component of the frequency spectrum by means of the regulating and control device. This offers the advantage that an equalization of the spectral components (low-frequency, medium-frequency, high-frequency) can be achieved as fast as possible, as a result of which a perceived sharpness of the noise can be reduced especially rapidly. The utilization of porous absorbers represents a reliable possibility for reducing the high-frequency spectral components of the frequency spectrum.

BRIEF DESCRIPTION OF THE DRAWING

The invention is illustrated in the drawing on the basis of embodiments and will be described further with reference to the drawing. Shown is:

FIG. 1 a schematic diagram of an improvement in a noise quality by a method according to the invention and by a regulating and control device according to the invention.

DETAILED DESCRIPTION

FIG. 1 shows a schematic diagram of an improvement in noise quality by a method according to the invention and by a regulating and control device according to the invention. The diagram shows, on the X axis, the frequency spectrum in hertz (Hz) and, on the Y axis, the sound pressure level in decibels (dB). Plotted in an upper curve 11 is an improved noise quality and plotted in a lower curve 12 is a previous initial situation. Shown here is an exemplary optimization of the subjective perception of the noise quality by enhancement of the low-frequency components.

The method according to the invention for influencing an acoustic noise of an air-conditioning system of a vehicle is based on the diagram, shown schematically in FIG. 1, for the improvement in the noise quality. In this case, the method according to the invention comprises the reduction of an psychoacoustic variable, in particular a sharpness of the sound, of the air-conditioning system by influencing a low-frequency and/or medium-frequency spectral component of a frequency spectrum of the sound of the air-conditioning system.

By influencing the acoustic noise of the air-conditioning system, in particular by influencing the sound of the air-conditioning system, it is possible to improve decisively a subjectively perceived noise quality of the air-conditioning noises of the air-conditioning system. The sound of the air-conditioning system is influenced by influencing the psychoacoustic variable—in particular the sharpness—of the sound of the air-conditioning system. The sharpness is a key component of the tone and a perceived variable of the psychoacoustics. The sharpness of the sound can be influenced by a change in spectral components of a frequency spectrum of the sound. Thus, a large imbalance between low-frequency, medium-frequency, and high-frequency spectral components of the frequency spectrum of the sound, in particular a high proportion of high-frequency spectral components in comparison to low-frequency and/or medium-frequency spectral components of the frequency spectrum, is perceived as being especially "sharp." Influencing the noise by influencing the psychoacoustic variable "sharpness" of the sound makes it possible to improve the noise quality, because a reduction in a sound pressure level solely via porous absorbers is subject to physical limits.

In particular, the sharpness of the sound of the air-conditioning system is influenced by influencing a low-frequency and/or medium-frequency spectral component of a frequency spectrum of the sound of the air-conditioning system. This offers the advantage that influencing the low-frequency and/or medium-frequency spectral components of the frequency spectrum of the sound makes possible a reduction in the sharpness of the acoustic noise, as a result of which an overall improvement in the noise quality of the air-conditioning system of the vehicle is achievable. By way of the method according to the invention, it is thus possible to improve a noise quality for a vehicle passenger in that a perceived sharpness of the sound is improved. In addition to the enhancement of the low-frequency and/or medium-frequency spectral component of the frequency spectrum of the sound, it is possible to influence a high-frequency spectral component of the frequency spectrum of the sound, whereby there results a reduction in the high-frequency spectral component of the frequency spectrum of the sound of the air-conditioning system. The high-frequency spectral component of the frequency spectrum can be additionally influenced by a porous absorber.

The invention claimed is:

1. A method for influencing an acoustic noise of an air-conditioning system of a vehicle, comprising:

influencing, by a regulating or control device, at least one of a low-frequency and a medium-frequency spectral component of a frequency spectrum of a sound of the air conditioning system; and reducing, by a regulating or control device, a psychoacoustic variable from the air-conditioning system, in particular a sharpness of a sound, to reduce the acoustic noise of the air conditioning system, based on the at least one of the influenced low-frequency and medium-frequency spectral component.

2. The method according to claim 1, wherein said influencing comprising enhancing at least one of the low-frequency and the medium-frequency spectral component of the frequency spectrum of the sound of the air-conditioning system.

3. The method according to claim 1, wherein, said influencing further comprising: influencing, by at least one porous absorber, a high-frequency spectral component of the frequency spectrum of the sound.

4. The method according to claim 3, wherein said reducing further comprising: reducing the sharpness of the sound based on the influenced high-frequency spectral component of the frequency spectrum.

5. The method according to claim 1, wherein said influencing further comprising: influencing a high-frequency spectral component of the sound of the air-conditioning system by using the regulating or control device to interact with a porous absorber; and said reducing further comprising: reducing the sharpness of the sound based on the influenced high-frequency spectral component of the frequency spectrum.

6. The method according to claim 1, wherein said influencing further comprising: reducing a high-frequency spectral component of the sound of the air-conditioning system by using the regulating or control device to interact with a porous absorber; and said reducing further comprising: reducing the sharpness of the sound based on the reduced high-frequency spectral component of the frequency spectrum.

* * * * *